US012594466B2

(12) United States Patent
Merguerian et al.

(10) Patent No.: US 12,594,466 B2
(45) Date of Patent: Apr. 7, 2026

(54) DEVICE FOR STORING A GAME BALL UNDER PRESSURE

(71) Applicant: BOUNCE SPORTS INTERNATIONAL, Rixensart (BE)

(72) Inventors: Gregory Merguerian, Rixensart (BE); Maxime Sohet, Rixensart (BE); Antoine Wouters, Rixensart (BE); Julian Gamper, Rixensart (BE); Hugo Janton, Rixensart (BE); Lionel Convent, Rixensart (BE); Christophe Everarts, Rixensart (BE)

(73) Assignee: BOUNCE SPORTS INTERNATIONAL, Rixensart (BE)

( * ) Notice: Subject to any disclaimer, the term of this patent is extended or adjusted under 35 U.S.C. 154(b) by 0 days.

(21) Appl. No.: 18/851,004

(22) PCT Filed: Feb. 3, 2023

(86) PCT No.: PCT/EP2023/052699
§ 371 (c)(1),
(2) Date: Sep. 25, 2024

(87) PCT Pub. No.: WO2023/179949
PCT Pub. Date: Sep. 28, 2023

(65) Prior Publication Data

US 2025/0235752 A1 Jul. 24, 2025

(30) Foreign Application Priority Data

Mar. 25, 2022 (BE) ..... 2022/5212

(51) Int. Cl.
*A63B 39/02* (2006.01)
*A63B 102/02* (2015.01)
*A63B 102/08* (2015.01)

(52) U.S. Cl.
CPC ..... *A63B 39/025* (2013.01); *A63B 2102/02* (2015.10); *A63B 2102/08* (2015.10)

(58) Field of Classification Search
CPC ..... A63B 39/025; A63B 2102/02; A63B 2102/08; F01B 19/00; B65D 41/0442
(Continued)

(56) References Cited

U.S. PATENT DOCUMENTS 3,415,357 A * 12/1968 Van Natter ..... A63B 39/025 206/315.9
3,819,040 A * 6/1974 Coons ..... B65D 41/0442 206/315.9
(Continued)

FOREIGN PATENT DOCUMENTS

CN 204236892 U * 4/2015
CN 104816881 A * 8/2015
(Continued)

OTHER PUBLICATIONS

International Search Report mailed Apr. 6, 2023, issued in corresponding International Application No. PCT/EP2023/052699, filed Feb. 3, 2023, 5 pages.
(Continued)

*Primary Examiner* — Ernesto A Grano
*Assistant Examiner* — Symren K Sanghera
(74) *Attorney, Agent, or Firm* — Christensen O'Connor Johnson Kindness PLLC

(57) ABSTRACT

A device for storing at least one game ball under pressure, the device having a container with a leak-tight cover and a casing arranged around, and at a distance from, the container, and a pump for pumping ambient air into the container. The pump can include an annular piston arranged between the container and the casing, a handle connected to the piston for moving the piston translationally along the
(Continued)

container, a first non-return valve for admitting ambient air into a compression chamber between the casing and the container, and a second non-return valve, arranged between the compression chamber and an internal volume of the container, for transferring air from the compression chamber to the container.

8 Claims, 2 Drawing Sheets

(58) Field of Classification Search
USPC ..... 220/304; 215/352
See application file for complete search history.

(56) References Cited

U.S. PATENT DOCUMENTS 3,897,874 A * 8/1975 Coons ..... B65D 41/0442 206/315.9
4,020,948 A * 5/1977 Won ..... A63B 39/025 206/315.9
4,838,007 A * 6/1989 Graf ..... A63B 39/04 53/88
5,311,988 A * 5/1994 Bronson ..... B65D 81/2053 220/780
5,615,596 A * 4/1997 Issa ..... A63B 39/025 206/315.9

FOREIGN PATENT DOCUMENTS

DE 3631260 A1 * 3/1987 ..... B65D 81/2053
DE 3536430 A1 * 4/1987 ..... A63B 39/025
DE 3707466 A1 * 9/1988 ..... A63B 39/025
DE 3738019 A1 * 5/1989 ..... A63B 39/025
DE 3805008 A1 * 8/1989 ..... A63B 39/025
DE 9411154 U1 * 7/1994
DE 102011114480 A1 * 3/2013 ..... A63B 39/025

OTHER PUBLICATIONS

Written Opinion mailed Apr. 6, 2023, issued in corresponding International Application No. PCT/EP2023/052699, filed Feb. 3, 2023, 8 pages.

* cited by examiner

DEVICE FOR STORING A GAME BALL UNDER PRESSURE

CROSS-REFERENCE TO RELATED APPLICATIONS

This application is a National Stage of International Application No. PCT/EP2023/052699, filed Feb. 3, 2023, which claims priority to Belgian Patent Application No. 2022/5212, filed Mar. 25, 2022, the entire disclosures of which are hereby incorporated by reference in their entirety for all purposes.

FIELD OF THE INVENTION

The invention relates to a device for containing and pressurising one or more game balls, such as for example tennis or padel balls.

PRIOR ART

Many devices have been developed for containing game balls and for pressurising and storing these balls when not in use.

For example, such a device is known from document DE9411154U1. This device has a pipette on its lid, which allows a pressurised air supply to be connected to it in order to bring its internal volume to a pressure that is higher than atmospheric pressure and therefore better preserve the balls contained therein. However, this is not practical because a separate source of compressed air is required.

To solve this problem, document U.S. Pat. No. 3,415,357 proposes fitting the device with a bellows pump that can be operated by the user in order to pressurise the ball container. However, such a pump mechanism is complicated to manufacture and use. It is also relatively bulky and not very attractive.

Document U.S. Pat. No. 3,819,040A proposes a variant consisting of providing two containers that fit into each other and each of which is fitted with screw threads allowing their internal volume to be pressurised by screwing one container onto the other. However, such a solution comes with sealing issues over time and therefore does not allow the balls to be kept under pressure for a sufficiently long time.

Such a device is also known from document CN104816881. However, such a device is not practical to use, in particular with regard to its handling and the activation of its pump.

SUMMARY OF THE INVENTION

One aim of the invention is to provide a device for storing at least one game ball under pressure and which at least partially addresses the problems of the known devices, and/or to provide an alternative to the known devices.

The invention is defined by the independent claims. The dependent claims define preferred embodiments of the invention.

According to the invention, a device is provided for storing at least one game ball, said device comprising:

- a cylindrical container capable of containing the at least one game ball and provided with a lid for opening the container in order to introduce the at least one game ball therein and to close the container in a sealed manner;
- a cylindrical casing arranged coaxially around and at a distance from the container; and

- a pump for pumping ambient air into the container.

The pump comprises:

- an annular compression piston arranged around the container and between the container and the casing, therefore defining a compression chamber between said compression piston, said casing and said container;
- an external handle connected to the compression piston for moving the compression piston translationally along the container;
- a first non-return valve arranged between the compression chamber and the ambiance to allow ambient air into the compression chamber; and
- a second non-return valve arranged between the compression chamber and a volume inside the container to transfer air from the compression chamber to the volume inside the container.

Since such a device has its own integrated pump, it is therefore not necessary to provide separate means for pressurising the ball container. It is also simpler to produce and use than known devices.

Preferably, the container is capable of containing at least one tennis ball or at least one padel ball. Indeed, this is the most common use of such a device.

Preferably, the container has the shape of a right cylinder and the casing has the shape of a right cylinder.

Preferably, the handle is connected to the compression piston via a tube having the shape of a right cylinder.

More preferably, the container has the shape of a right circular cylinder, the casing has the shape of a right circular cylinder, and the handle is connected to the compression piston via a tube having the shape of a right circular cylinder.

In the context of the present invention, the term "cylinder" is to be understood according to the geometric meaning of this term. Therefore, a cylinder is a ruled surface whose generatrices are parallel, i.e. a surface in space consisting of right lines or segments of parallel right lines. A prism, a cube, a parallelepiped or a cylinder of revolution are examples of cylinders. A right cylinder is a cylinder whose base is perpendicular to its generatrices. A circular cylinder is a cylinder whose base is circular (or whose cross-section is a circle). A cylindrical shape or the adjective cylindrical therefore refers to an object having the shape of a cylinder.

Preferably, the handle is arranged on a side opposite the lid, which makes it easier to open the lid to insert the game ball(s) into the container.

Preferably, the lid is provided with a container pressure relief valve, which makes it possible to decompress the container before opening the lid to remove the game ball(s). More preferably, the pressure relief valve can be operated from the outside by a user.

BRIEF DESCRIPTION OF THE FIGURES

These and other aspects of the invention will be clarified in the detailed description of particular embodiments of the invention, with reference to the drawings for the figures, wherein.

The drawings for the figures are neither to scale nor proportionate. Generally, similar or identical elements are indicated by identical references in the figures.

DETAILED DESCRIPTION OF EMBODIMENTS OF THE INVENTION

Figure 1:
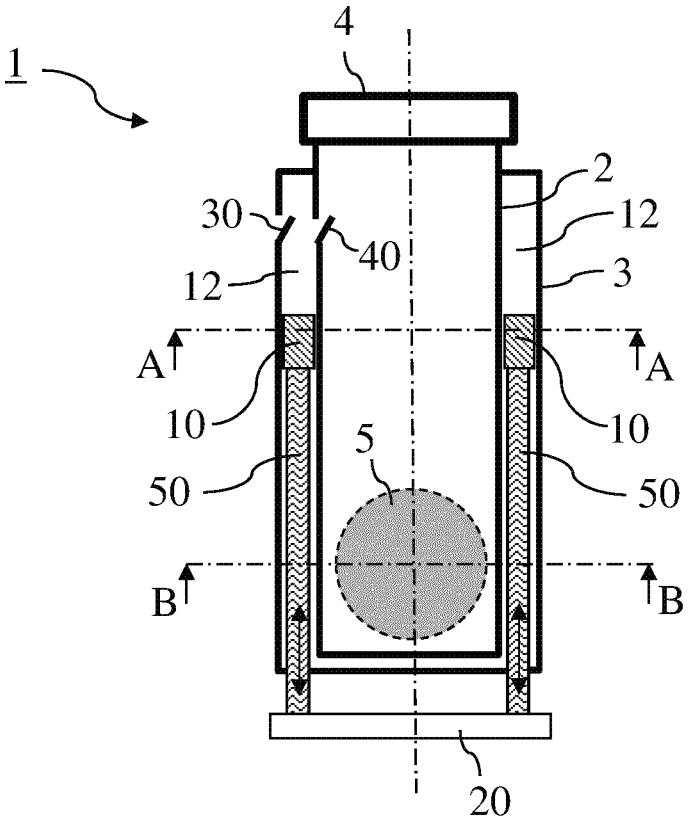
FIG. 1 schematically shows a longitudinal sectional view of an exemplary embodiment of a device according to the invention.

FIG. 1 schematically shows a longitudinal sectional view of an exemplary embodiment of a device (1) according to the invention.

The device (1) comprises a cylindrical container (2) capable of containing the at least one game ball (5) and being provided with a lid (4) to open the container (2) in order to introduce the at least one game ball (5) therein and to close the container (2) in a sealed manner. The lid (4) may for example be of the type to be screwed onto the container (2) or be hinged with a mechanism for tightening the lid (4) onto the container (2). Sealing may be ensured by various known means, such as for example the use of one or more seals between the lid (4) and the container (2).

Preferably, the container (2) has the shape of a right cylinder and the casing (3) has the shape of a right cylinder.

Preferably, the container (2) is sized so that the game balls are stacked in the container (2). Preferably, the container (2) is sized to contain a maximum of eight game balls or a maximum of six game balls or a maximum of four game balls. Preferably, the container (2) is capable of containing at least one tennis ball or at least one padel ball.

The device (1) further comprises a cylindrical casing (3) arranged coaxially around and at a distance from the container (2).

The device (1) further comprises a pump for pumping ambient air into the container (2). For this purpose, the pump comprises an annular compression piston (10) arranged around the container (2) and between the container (2) and the casing (3), thereby defining a compression chamber (12) between said compression piston (10), said casing (3) and said container (2).

The pump further comprises two non-return valves:

- a first non-return valve (30) arranged between the compression chamber (12) and the ambiance to allow ambient air into the compression chamber (12); and
- a second non-return valve (40) arranged between the compression chamber (12) and a volume inside the container (2) to transfer pressurised air from the compression chamber (12) to the volume inside the container (2).

The first non-return valve (30) may for example be placed on a wall of the casing (3), as shown in FIG. 1. Alternatively, the first non-return valve (30) may for example be placed on the compression piston (10) so as to allow ambient air to pass through the piston and towards the compression chamber (12).

The second non-return valve (40) may for example be placed on a wall of the container (2), as shown in FIG. 1.

The pump also comprises an external handle (20) connected to the compression piston (10) for moving the compression piston (10) translationally along the container (2) (movement indicated by a double arrow in FIG. 1). Preferably the handle (20) is connected to the compression piston (10) via a tube (50) having the shape of a right cylinder. Said tube (50) is of course sized to be able to be inserted between the container (2) and the casing (3).

Alternatively, the handle (20) can be connected to the compression piston (10) by other means, such as by rods or by strips for example. Preferably, the first and second non-return valves (40) are placed on a side opposite the handle (20) in order to reduce a dead volume in the compression chamber (12).

It will therefore be clear that by pulling the handle (20) (vertical downward movement in the representation in FIG. 1), ambient air will be allowed into the compression chamber (12) via the first non-return valve (30), and that by pushing the handle (20) (vertical upward movement in the representation of FIG. 1), this air will be pressurised and transferred from the compression chamber (12) to a volume inside the container (2) via the second non-return valve (40), thus pressurising the volume inside the container (2) as well as the game ball(s) contained therein.

Preferably, the handle (20) is arranged on a side opposite the lid (4), which makes it easier to open the lid (4) to insert the game ball(s) into the container (2).

Figure 2:
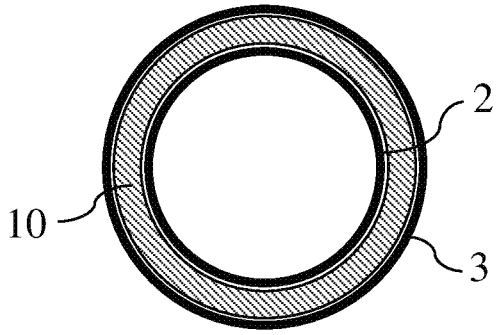
FIG. 2 schematically shows a cross-sectional view along a plane AA of the device of FIG. 1.

FIG. 2 schematically shows a cross-sectional view along a plane AA of the device (1) of FIG. 1, i.e. a plane passing through the piston.

In this example, the container (2), the casing (3) and the tube (50) connecting the handle (20) to the piston all have the shape of a right circular cylinder and the piston has the shape of a circular ring. As in any piston pump, the piston will of course be adjusted to the dimensions of the container (2) and the casing (3) and may possibly be fitted with segments or an O-ring or any other means providing a good seal to compress the air in the compression chamber (12). Other cylindrical shapes are also possible. The container (2), the casing (3) and the tube (50) connecting the handle (20) to the piston may for example all have the shape of an oval or elliptical cylinder, i.e. a cylinder whose base or a section is an oval or an ellipse.

Figure 3:
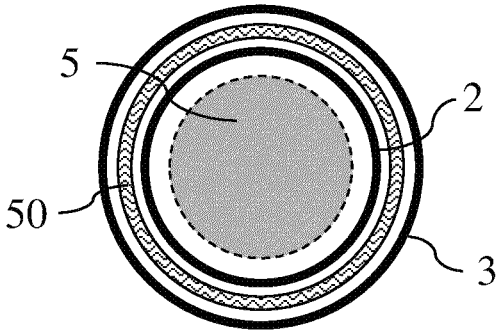
FIG. 3 schematically shows a cross-sectional view along a plane BB of the device of FIG. 1.

FIG. 3 schematically shows a cross-sectional view along a plane BB of the device (1) of FIG. 1, i.e. a plane passing through the tube (50) connecting the handle (20) to the piston and through a game ball (5) contained in the container (2) (said game ball (5) not forming part of the invention). In this figure, we can see more specifically a cross-section of the tube (50) connecting the handle (20) to the piston. Preferably, said tube (50) will have a thickness that is slightly less than the spacing between the container (2) and the casing (3) so as not to rub against the walls of the container (2) and/or the casing (3). Preferably, the container (2) will have an internal diameter that is slightly greater than the diameter of the game ball (5) that it is intended to contain. In cases where the container (2) has the shape of a circular cylinder, the inner diameter of the container (2) will for example be between 102% and 150% of the diameter of the game ball (5) that it is intended to contain.

Figure 4:
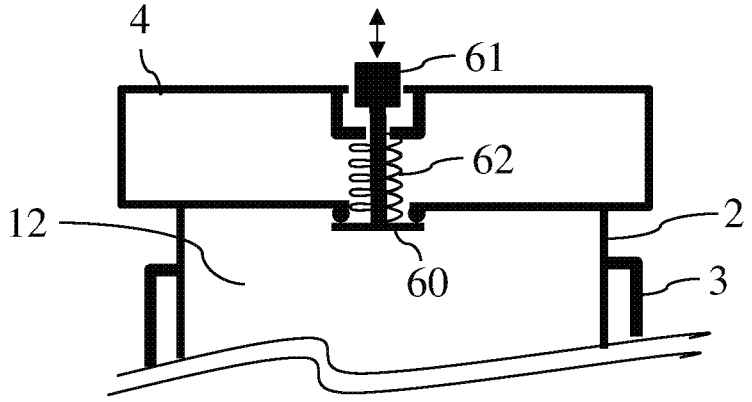
FIG. 4 schematically shows a partial longitudinal sectional view of an exemplary embodiment of a preferred device according to the invention.

FIG. 4 schematically shows a partial longitudinal sectional view of an exemplary embodiment of a preferred device (1) according to the invention.

In this example, the lid (4) is provided with a pressure relief valve (60) of the container (2). Such a valve is generally known as such. When operated, this valve is used to evacuate the air previously pressurised in the container (2) and therefore to reduce the pressure in the container (2), or even to return the container (2) to atmospheric pressure before opening the lid (4) to remove the game ball(s).

Preferably, the pressure relief valve (60) can be operated from the outside by a user, for example by a button (61) as shown in FIG. 4. Preferably, and as illustrated in FIG. 4, the pressure relief valve (60) is pre-tensioned by a spring (62) in order to keep the valve closed in the absence of pressure in the container (2).

This invention has been described in relation to specific embodiments, which are for illustration purposes only and should not be considered as limiting. In general, it will be obvious to those skilled in the art that this invention is not limited to the examples illustrated and/or described above. The presence of reference numbers in the drawings cannot be considered as limiting, including when these numbers are indicated in the claims.

The use of the verbs "comprise", "include", "involve", or any other variant, as well as conjugations thereof, cannot in any way exclude the presence of elements other than those mentioned.

The use of the indefinite article "a", or the definite article "the" to introduce an element does not exclude the presence of a plurality of such elements.

The invention can also be described as follows: a device (1) for storing at least one game ball (5) under pressure and comprising a container (2) provided with a sealed lid (4) and a casing (3) arranged around and at a distance from the container (2) and a pump for pumping ambient air into the container (2). The pump comprises an annular piston arranged between the container (2) and the casing (3), a handle (20) connected to the piston for moving the piston translationally along the container (2), a first non-return valve (30) for allowing ambient air into a compression chamber (12) between the casing (3) and the container (2), and a second non-return valve (40) arranged between the compression chamber (12) and a volume inside the container (2) for transferring air from the compression chamber (12) to the container (2).

The invention claimed is:

1. A device for storing at least one game ball, the device comprising:

a cylindrical container configured to contain the at least one game ball and having a lid for opening the cylindrical container to introduce the at least one game ball therein and to close the cylindrical container in a sealed manner;

a cylindrical casing arranged coaxially around and at a distance from the cylindrical container; and a pump for pumping ambient air into the cylindrical container, the pump having:

an annular compression piston arranged around the cylindrical container and between the cylindrical container and the casing, thereby defining a compression chamber between the compression piston, the casing, and the cylindrical container;

an external handle connected to the compression piston for moving the compression piston translationally along the cylindrical container;

a first non-return valve arranged between the compression chamber and the ambiance to allow ambient air into the compression chamber; and a second non-return valve arranged between the compression chamber and a volume inside the cylindrical container to transfer air from the compression chamber to the volume inside the cylindrical container.

2. The device according to claim 1, wherein the cylindrical container is configured to contain at least one tennis ball or at least one paddle ball.

3. The device according to claim 1, wherein the cylindrical container has the shape of a right cylinder, and wherein the casing has the shape of a right cylinder.

4. The device according to claim 1, wherein the handle is connected to the compression piston via a tube having the shape of a right cylinder.

5. The device according to claim 3, wherein the cylindrical container has the shape of a right circular cylinder, wherein the casing has the shape of a right circular cylinder, and wherein the handle is connected to the compression piston via a tube having the shape of a right circular cylinder.

6. The device according to claim 1, wherein the handle is arranged on a side of the device opposite the lid.

7. The device according to claim 1, wherein the lid includes a pressure relief valve for the cylindrical container.

8. The device according to claim 7, wherein the pressure relief valve may be operated from outside the device by a user.

* * * * *